United States Patent [19]

Akira

[11] 4,455,457

[45] Jun. 19, 1984

[54] ADJUSTER MEANS FOR HEADSET

[75] Inventor: Jingu Akira, Gunma, Japan

[73] Assignee: Tokumi Denshi Kogyo Kabushiki Kaisha, Gunma, Japan

[21] Appl. No.: 384,124

[22] Filed: Jun. 1, 1982

[30] Foreign Application Priority Data

Oct. 20, 1981 [JP] Japan ..... 56-155553[U]

[51] Int. Cl.[3] ..... H04R 1/10

[52] U.S. Cl. ..... 179/156 R; 2/209

[58] Field of Search ..... 179/156 R, 156 A, 182 R, 179/182 A; 2/209

[56] References Cited

U.S. PATENT DOCUMENTS

| | | | |
|---|---|---|---|
| 1,714,377 | 5/1929 | Kiernan | 179/156 R |
| 2,420,245 | 5/1947 | Hurst | 179/156 R |

FOREIGN PATENT DOCUMENTS

| | | | |
|---|---|---|---|
| 2229966 | 12/1972 | Fed. Rep. of Germany | 179/156 R |
| 2643157 | 9/1976 | Fed. Rep. of Germany | 179/156 R |
| 1508101 | 4/1978 | United Kingdom | 179/156 R |

*Primary Examiner*—Harold I. Pitts
*Assistant Examiner*—L. C. Schroder
*Attorney, Agent, or Firm*—Ladas & Parry

[57] ABSTRACT

A means for adjusting the set position of the head band in a headset is disclosed.

An elastic member is provided fixedly at each end of the head band, said elastic member being designed such that its protuberant portion is able to project out or retract from the side surface of the head band. Also, a plurality of undulate recessions are formed regularly at given intervals along the inner wall of the hole in each flattened tubular body joined to a corresponding earphone unit, said recessions being designed such that the protuberant portion of said elastic member may be elastically engaged in one of them.

By this means, the head band can be adjustably secured to the flattened tubular bodies with no fear of causing any incidental dislocation or shift of the set positions of the earphone units relative to the head band. Any desired change of the set position can be effected with ease.

4 Claims, 9 Drawing Figures

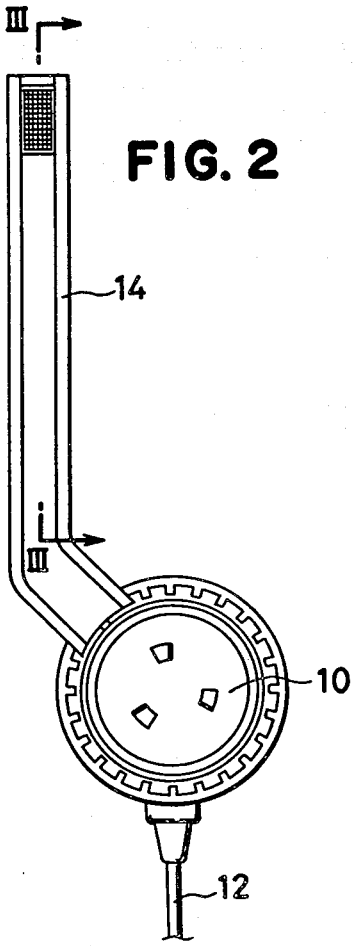
FIG. 2
FIG. 3
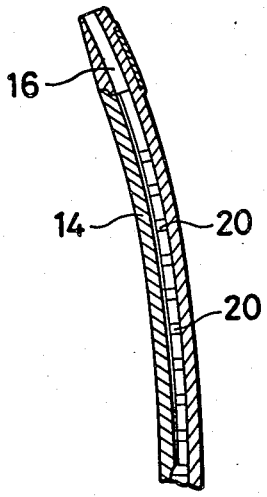
FIG. 4
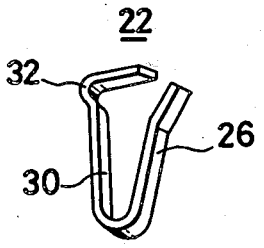

ADJUSTER MEANS FOR HEADSET

BACKGROUND OF THE INVENTION

A. Field of the Invention

This invention relates to a means for adjusting the position of each earphone or receiver unit in a headset, and more particularly it relates to said adjuster means featuring the provision of an elastic projecting member fixed in position at each end of the head band, said elastic member being designed to be able to elastically fit in any one of a plurality of recessions or dents formed regularly at given intervals along the inner wall of the hole of a flattened tubular body secured to the corresponding earphone unit, thereby allowing telescopically adjustable secure positioning of the head band in said flattened tubular bodies.

B. Description of the Prior Art

A headset is used for listening personally to the radio, stereo music apparatus, tape recorder or the like. In this case, it is required that the body portion of each earphone which transmits the voice or sound to the lister's ear be attached pat and tightly to the ear.

The conventional headsets were mostly of a structure in which each end of the head band is inserted into the fixture of the corresponding earphone support and said both head band and earphone support are fixed in position by dint of a frictional resistance produced therebetween upon insertion, thereby securing the head band against removal from the earphone support.

In such form of attachment, however, since securing of the head band position relative to the earphone support relies on a frictional resistance alone, the earphone support is liable to get loose or shift from the head band, causing dislocation of the earphone from the proper position on the ear. Also, such conventional design has the disadvantage that it is hardly possible to precisely change the set position of each earphone stepwise along a given distance.

SUMMARY OF THE INVENTION

A principal object of this invention is to provide an improved adjuster means for a headset.

Another object of this invention is to provide a means which is capable of securely and adjustably positioning the head band relative to each earphone unit.

Still another object of the invention is to provide a means that allows precise and easy change of the set position of each earphone.

In order to accomplish these objects, the present invention provides a novel headset mechanism featuring incorporation of an elastic projecting member secured in position close to each end of the head band, said member being designed to be able to elastically fit in one of a plurality of recessions or dents formed at regular intervals along the inner wall of the hole of a flattened tubular body to thereby allow telescopically adjustable secure positioning of the head band in said tubular body.

Other objects and advantages of this invention will become apparent as this description proceeds to describe the invention with reference to the accompanying drawings. It is to be understood, however, that the disclosures given herein merely show some preferred embodiments of the invention and are not to be taken as limiting the present invention.

BRIEF DESCRIPTION OF THE DRAWINGS

FIG. 2 is an enlarged sectional view of a flattened tubular body and an earphone unit of the headset shown in FIG. 1.

FIG. 3 is a sectional view taken along the line III—III of FIG. 2.

FIG. 4 is a perspective view of an elastic projecting member.

DETAILED DESCRIPTION OF THE PREFERRED EMBODIMENTS

Some preferred embodiments of the present invention are described hereinbelow with reference to the accompanying drawings.

Figure 1:
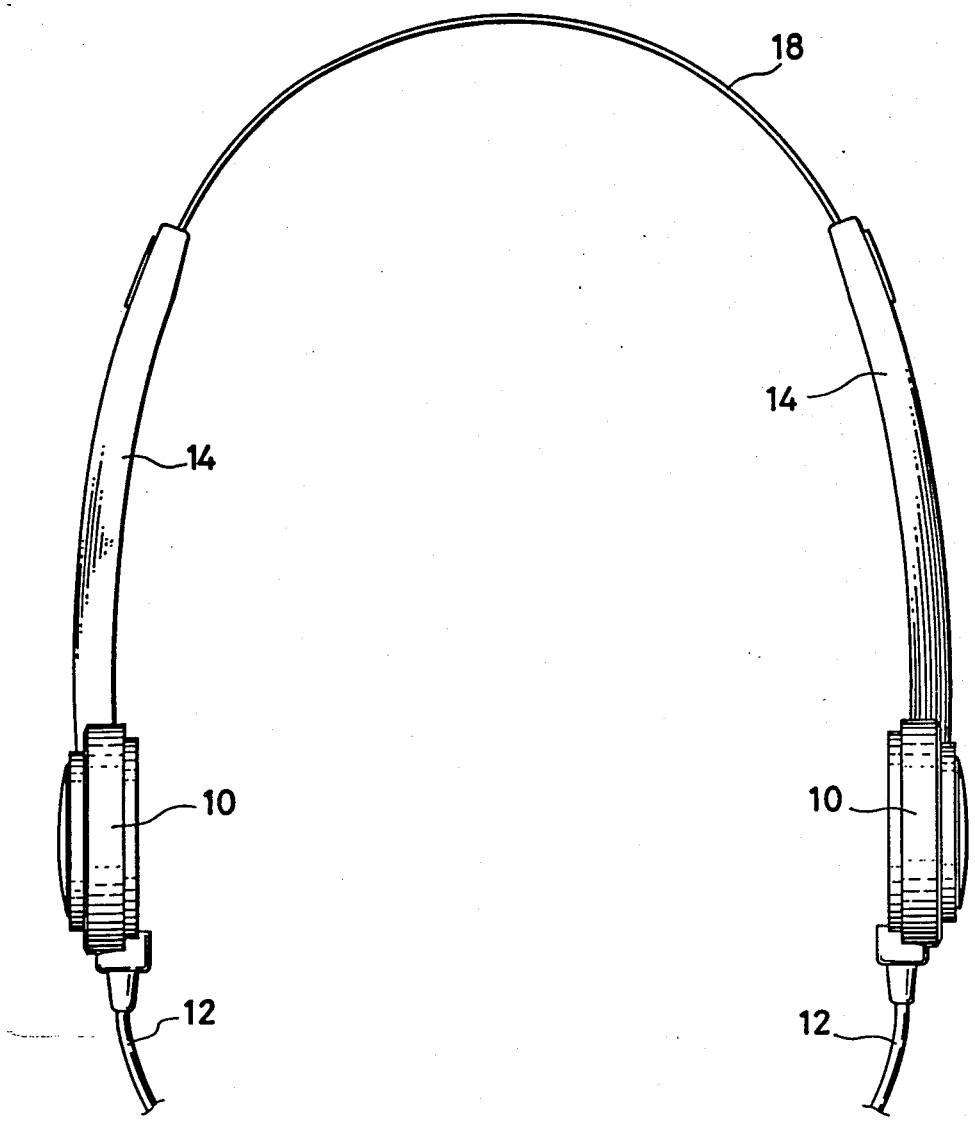
FIG. 1 is a general, front elevational view of an embodiment of the headset according to this invention, with the conducting wire cords being partly cut off.

Referring to FIG. 1, there is shown a general view of a headset in accordance with this invention. The headset comprises a pair of earphone units 10 designed to be attached to the user's ears and having the function of converting the received electric signal into a sound or voice. Each of said earphone units 10 houses therein a diaphragm and other elements constituting a transducer. Connected to each said earphone unit 10 is a conducting wire 12 for transmitting the electric signal thereto, with most of said conducting wire 12 being omitted in the drawing.

Each earphone unit 10 is integrally joined to the lower end of a plastic flattened tubular body 14. Said flattened tubular body 14 is gently curved so as to conform to the shape of the temple of man, and as shown in FIGS. 2 and 3, it has centrally therein a passageway or hole 16, rectangular in sectional shape, extending along the full length of the tubular body. Both ends of the head band 18 are inserted into said holes 16 in the respective tubular bodies 14 to integrally join both earphone units 10 to constitute a headset. The head band 18, designed to be passed over the user's head, is made of an arcuate elastic body so that both earphone bodies will be properly pressed against both temple portions of the head under a moderate elastic force.

Figure 5:
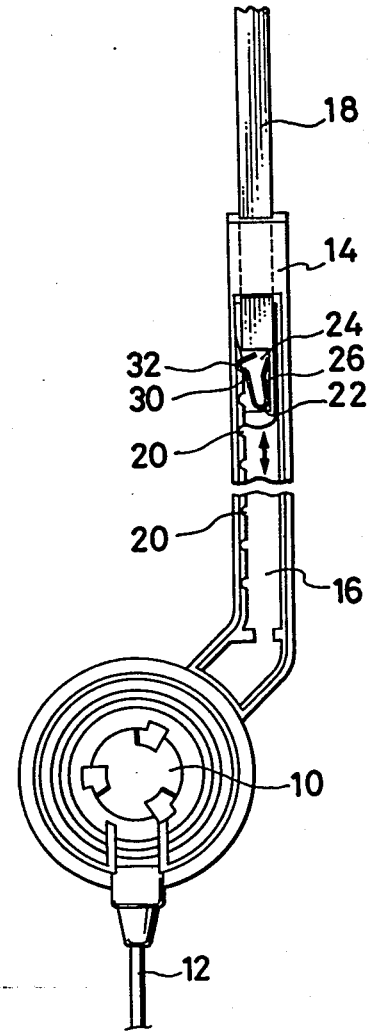
FIG. 5 is a side view, partly shown in section, illustrating a mode of engagement between the head band and a flattened tubular body.
Figure 6:
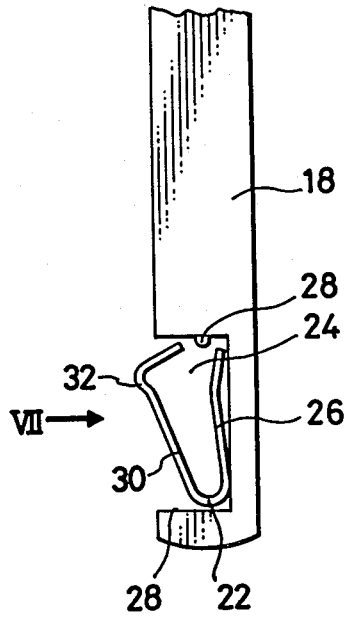
FIG. 6 is an enlarged view illustrating a condition in which the elastic projecting member is secured in position in a cutout in the head band.
Figure 7:
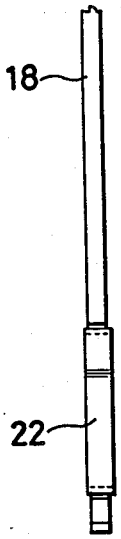
FIG. 7 is a view taken in the direction of arrow VII of FIG. 6.

The means for adjusting the relative fixed positions of each earphone unit 10 and the head band 18, which is the primary feature of this invention, is constructed and incorporated in a headset such as described above in the following way. A plurality of recessions or dents 20 are formed at regular intervals along the inside wall of the hole 16 of each flattened tubular body 14 as shown in FIGS. 3 and 5. These undulate recessions 20 formed regularly at given intervals as said above are designed such that the elastic projecting member 22 in the head band 18 can elastically fit in any one of them. As shown in FIGS. 5 and 6, said elastic projecting member 22 is fixed in position in a cutout 24 provided close to each end of the head band 18 which is inserted into the corresponding flattened tubular body 14. This elastic projecting member 22, as best shown in FIGS. 4 and 6, is made of a highly elastic metal strip or wire which is substantially bent into two portions, with one of the portions 26 being fixed in position in the cutout 24 in the head band 18. Such fixing may be effectuated by securing said portion 26 in the cutout 24 by welding or other means, or by providing a stop 28 in the cutout 24 as shown in FIG. 6. The other portion 30 of the bent-in-two elastic member 22 functions as an elastic cantilever at an acute angle to the length of head band 18, with a round protuberance or lobe 32 being formed toward the free end of said portion 30. Owing to the elastic flexibility of the elastic portion 30, said lobe 32 can project out or retract from the side surface (in the cutout portion) of the head band 18, and when it projects out, it elastically fits into one of the recessions 20 in the hole 16 of the flattened tubular body 14.

Now, the functions of said elastic projecting member 22 and the recessions 20 in the hole 16 are described with particular reference to FIG. 5 where only one earphone unit 10 and the associated flattened tubular body 14 are shown. When the end of the head band 18 having said elastic projecting member 22 is duly set in the cutout 24, one portion 30 of said elastic member 22 initially stays retracted inwardly of the side surface of the head band 18, but when the lobe 32 of said elastic member 22 reaches the position of one of the recessions 20 in the hole 16, said lobe 32 projects out and elastically fits in said recession. The head band 18 may be further pushed into the tubular body 14 so that the elastic member 22 engages in any other recession 20 to thereby properly position the head band 18 by said elastic engagement. The head band 18 can be kept fast in the thus selected and fixed position by providing the elastic member 22 with a proper modulus of elasticity, and the thus positioned head band 18 won't be dislocated or get loose unless the headset user tries to further push the head band 18 into the flattened tubular body 14 or pull said band out of said tubular body. Also, since the elastic projecting member 22 of the instant embodiment is of a cantilever type, the head band 18 can move relatively easily in the direction where it is pushed into the hole 16, but it shows a fairly high resistance in the pulled-out direction. Thus, according to the present device, the head band fastening force is phenomenally enhanced in comparison with the conventional positioning means which rely on a frictional resistance, and it is also possible to precisely set the head band at a desired position owing to provision of a plurality of regularly arranged undulate recessions.

Figure 8:
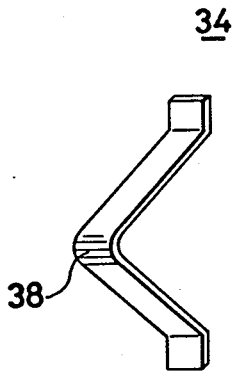
FIG. 8 is a perspective view of another embodiment of an elastic projecting member according to this invention.
Figure 9:
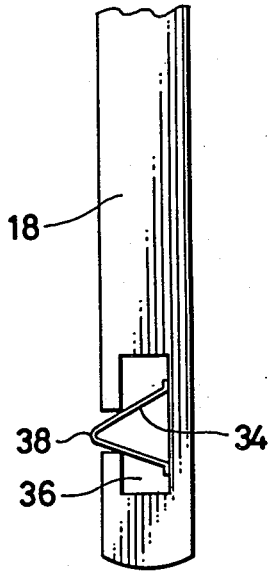
FIG. 9 is an illustration showing a condition of the elastic projecting member of FIG. 8 set in position in the head band.

FIGS. 8 and 9 show a modification of the elastic projecting member in accordance with this invention. In this case, the elastic projecting member 34 is arcuately bent substantially at its center to form two symmetrical portions. Said member 34 is housed in a cutout 36 of the head band 18, with both ends of said member being pressed slidably against the recessed wall of said cutout 36 so that the central arched portion 38 is able to project out or retract from the side surface of the head band 18.

In this modification, as compared with the aforesaid embodiment, the mode of positioning the elastic projecting member 34 is slightly altered and also the two spring portions of said member are symmetric to each other, so that a uniform elastic engaging force is provided in both head band pushing-in and pulling-out directions. In addition, such elastic engaging force is further strengthened.

As apparent to those skilled in the art, the present invention admits of various other changes and modifications, and obviously the invention is not limited to the embodiments illustrated and described hereinabove.

What is claimed is:

1. An adjuster means for a headset comprising an arcuate head band made of an elastic material and a pair of flattened tubular bodies each of which is connected at its one end to a corresponding earphone unit and has a passageway formed centrally therein, wherein both ends of said head band are inserted into said passageways in said respective flattened tubular bodies to integrally join said head band and said flattened tubular bodies, an elastic projecting member secured in position close to each end of said head band and a plurality of recessions or dents formed regularly at given intervals along an inner wall of each said passageway, said recessions being designed so that said elastic projecting member may be elastically fitted in any one of said recessions, thereby allowing telescopically adjustable secure positioning of said head band in said flattened tubular bodies, the elastic projecting members being bent in two portions, with only a first one of said portions being entirely housed and fixed in position in a cutout in the head band, said cutout defining an opening along an edge of said head band in facing relationship to said inner wall of said passageway, while a second elastic one of said portions is cantilevered outwardly from said recess towared said inner wall and has a lobe-like arched protuberance near its free end, said protuberance being arranged to project out or retract from said edge of the head band.

2. The adjuster means of claim 1 in which the second portion is cantilevered at an acute angle with respect to a length of the head band.

3. An adjuster means for a headset comprising an arcuate head band made of an elastic material and a pair of flattened tubular bodies each of which is connected at its one end to a corresponding earphone unit and has a passageway formed centrally therein, wherein both ends of said head band are inserted into said passageways in said respective flattened tubular bodies to integrally join said head band and said flattened tubular bodies, an elastic projecting member secured in position close to each end of said head band and a plurality of recessions or dents formed regularly at given intervals along an inner wall of each said passageway, said recessions being designed so that said elastic projecting member may be elastically fitted in any one of said recessions, thereby allowing telescopically adjustable secure positioning of said head band in said flattened tubular bodies, the elastic projecting member being arcuately shaped substantially at its center to form two symmetrical portions and an apex, said member being housed in a cutout in the head band, said cutout defining an opening along an edge of said head band in facing relationship to said inner wall of said passageway, with ends of said portions being slidably pressed against a recessed wall of said cutout, said central arched portion being arranged so that said apex projects from the edge of said head band outwardly toward said inner wall and retracts when force is applied to said apex.

4. The adjuster means of claim 2 in which the second portion is cantilevered from an end of the recess closest to the end of the head band.

* * * * *